US009103504B2

(12) United States Patent
Redmond et al.

(10) Patent No.: US 9,103,504 B2
(45) Date of Patent: Aug. 11, 2015

(54) INTERNAL GIRTH WELD LIQUID COATING CART

(75) Inventors: Mark Redmond, Toronto (CA); Joseph Mordarski, Brampton (CA); Josef Benedik, Mississauga (CA); Armen Markarian, Etobicoke (CA)

(73) Assignee: ShawCor Ltd., Toronto, Ontario (CA)

( * ) Notice: Subject to any disclaimer, the term of this patent is extended or adjusted under 35 U.S.C. 154(b) by 153 days.

(21) Appl. No.: 13/812,278

(22) PCT Filed: Jul. 26, 2011

(86) PCT No.: PCT/CA2011/050457

§ 371 (c)(1),
(2), (4) Date: Jun. 12, 2013

(87) PCT Pub. No.: WO2012/012899

PCT Pub. Date: Feb. 2, 2012

(65) Prior Publication Data

US 2013/0269812 A1 Oct. 17, 2013

Related U.S. Application Data

(60) Provisional application No. 61/367,652, filed on Jul. 26, 2010.

(51) Int. Cl.

| | |
|---|---|
| ***F17D 3/18*** | (2006.01) |
| ***B05B 3/10*** | (2006.01) |
| ***B05B 13/06*** | (2006.01) |
| *B05C 7/08* | (2006.01) |

(Continued)

(52) U.S. Cl.

CPC ..... *F17D 3/18* (2013.01); *B05B 3/1057* (2013.01); *B05B 13/06* (2013.01); *B05B 12/084* (2013.01); *B05B 15/0406* (2013.01); *B05C 7/00* (2013.01); *B05C 7/04* (2013.01); *B05C 7/08* (2013.01); *B05D 7/222* (2013.01); *Y10S 118/10* (2013.01)

(58) Field of Classification Search

CPC ..... B05C 7/00; B05C 7/02; B05C 7/04; B05C 7/08; Y10S 118/10; F16L 55/26; F16L 55/1645; B05B 13/06; B05B 3/1057; B05B 12/084; B05B 15/0406; F17D 3/18; B05D 7/222

USPC ..... 118/306, 317, DIG. 10; 134/166 R, 134/166 C, 8, 22.1, 22.11, 22.18; 138/97, 98

See application file for complete search history.

(56) References Cited

U.S. PATENT DOCUMENTS

| | | | | |
|---|---|---|---|---|
| 3,891,368 | A | 6/1975 | Hart | |
| 3,967,584 | A * | 7/1976 | Hasegawa et al. | 118/72 |

(Continued)

FOREIGN PATENT DOCUMENTS

| | | |
|---|---|---|
| CA | 2369714 | 7/2002 |
| DE | 10209485 | 10/2002 |

(Continued)

*Primary Examiner* — Laura Edwards

(74) *Attorney, Agent, or Firm* — DeLio, Peterson & Curcio, LLC; Peter W. Peterson

(57) ABSTRACT

The invention relates to a machine for coating the interior of a pipe. The machine can be pulled through and positioned within a pipe or pipeline by a internal pipe tractor, and can be used to apply viscous liquids, including two part epoxies and urethanes, to the interior wall of the pipe. The machine is typically used for the overcoating of portions of pipe having defects in their internal coatings, for example, at their girth welds.

13 Claims, 7 Drawing Sheets

(51) Int. Cl.

| | |
|---|---|
| *B05C 7/00* | (2006.01) |
| *B05C 7/04* | (2006.01) |
| *B05B 12/08* | (2006.01) |
| *B05B 15/04* | (2006.01) |
| *B05D 7/22* | (2006.01) |

(56) References Cited

U.S. PATENT DOCUMENTS

| | | | | |
|---|---|---|---|---|
| 4,092,950 | A * | 6/1978 | Hart | 118/669 |
| 4,178,875 | A * | 12/1979 | Moschetti | 118/712 |
| 5,181,962 | A | 1/1993 | Hart | |
| 5,976,619 | A * | 11/1999 | Weiss | 427/238 |
| 6,632,475 | B1 * | 10/2003 | Bleggi | 427/236 |
| 7,517,409 | B1 * | 4/2009 | Gillanders et al. | 118/317 |
| 2003/0039752 | A1 * | 2/2003 | Winiewicz et al. | 427/236 |

FOREIGN PATENT DOCUMENTS

| | | |
|---|---|---|
| JP | 141153 | 6/1997 |
| WO | WO03024624 | 3/2003 |

* cited by examiner

SECTION B-B

INTERNAL GIRTH WELD LIQUID COATING CART

CROSS-REFERENCE TO RELATED APPLICATION

This application is a 371 of PCT/CA2011/050457 filed Jul. 26, 2011, which claims the benefit of and priority to U.S. Provisional Patent Application No. 61/367,652 filed Jul. 26, 2010 under the title INTERNAL GIRTH WELD LIQUID COATING CART.

The content of the above patent application is hereby expressly incorporated by reference into the detailed description hereof.

FIELD OF THE INVENTION

The invention relates to a machine for coating the interior of a pipe. The machine can be pulled through and positioned within a pipe or pipeline by a internal pipe tractor, and can be used to apply viscous liquids, including two part epoxies and urethanes, to the interior wall of the pipe. The machine is typically used for the overcoating of portions of pipe having defects in their internal coatings, for example, at their girth welds.

BACKGROUND OF THE INVENTION

Metal pipelines, for example, oil or gas pipelines, are typically coated, both on the interior and the exterior, to protect the metal surface from corrosion or other undesirable effects. Coatings can include a wide variety of plastics, including polyethylene, polyurethane, or epoxy coatings. The exterior surface is typically coated to prevent corrosion due to contact with air or water, including salt water, for example, in transatlantic pipelines. The interior surface can also be coated, since contact with liquid material, for example, gas condensate, inside the pipeline can promote corrosion from within.

Typically, pipes used in pipelines are coated at the factory with a protective coating. The coating typically does not extend to the very ends of the pipes, since the metal must be exposed for attachment in the field. The pipes are then welded together at their ends, in the field, using girth welds; because these girth welds, and the surrounding surfaces, are typically exposed metal surfaces, they must then be coated, again, in the field. Exterior coatings are often in the form of a shrink wrap sleeve which is applied to the exterior surface of the exposed pipe, and shrunk into place using the application of heat. The interior surface of the exposed portion of the pipe surrounding (and including) the girth weld is often coated utilizing a preheated, liquid state plastic, utilizing a brush, or the application of a powder onto a pre-heated surface, said powder then melting to form a generally uniform coating.

As can be readily appreciated, once a pipeline is in place, access to the girth welds interspersed along its length can be problematic, especially on the interior of the pipe. Accordingly, internal pipe tractors have been developed, which can run along the inside of a pipe. The internal pipe tractors have wheels that run along the inside wall of the pipe, and can be controlled remotely, by an operator outside of the pipe. These internal pipe tractors can perform a variety of functions. For example, an internal pipe tractor can be hitched to an inspection cart, having lights and cameras for the visual inspection of the interior surface of a pipe. The inspection cart can identify minute defects in the pipe coating (known as holidays), for example, along the girth weld. Often these holidays are as small as a pin prick, but can be the point at which corrosion occurs.

Liquid coating carts are known in the art. For example, U.S. Pat. No. 5,181,962 describes a cart having an air compressor, a liquid coating material reservoir, and a rotating spray gun. The cart can be wheeled to a holiday/defect location using a standard internal pipe tractor. Then the rotating spray nozzle can be activated, such that liquid is sprayed through the spray gun utilizing the force of the compressed air, while the spray gun rotates. This coats the interior of the pipe with the liquid coating material. However, this type of liquid coating cart can only be used with liquid coating materials of low viscosity, and suffers from issues related to the clogging of the spray gun, which can be extremely inconvenient when the machine is several hundred feet away from the nearest operator.

SUMMARY OF THE INVENTION

According to one embodiment of the present invention is provided a liquid coating cart for coating an inside surface of a pipe, comprising: (a) a frame, having a rear end and a front end, and wheels capable of displacing the frame along the inside surface of the pipe; (b) a controller, capable of receiving instructions from a remote interface; (c) a cartridge containment block, capable of housing at least two fluid cartridges, each of said fluid cartridges containing fluid for coating the inside surface of the pipe; (d) a housing for a static mixer, located in or proximal to the cartridge containment block, and situated such that when fitted with a static mixer having a feeding end and a nozzle end, a channel is formed between the fluid cartridges and the feeding end of the static mixer, through which the fluid can be displaced; (e) a ram system capable of displacing said fluid out of said fluid cartridges and into said static mixer, and then through said static mixer and out of said nozzle end, said ram system controlled through the controller; (f) a fluid dispensing unit, comprising a cup having an interior bottom and an interior sidewall, said cup connected to a cup drive motor capable of rotating said cup around an axle connected to its interior bottom, said cup drive motor controlled through the controller; (g) said fluid dispensing unit capable of displacement between two positions, an operating position wherein the cup is proximal to the nozzle end of the static mixer such that fluid displaced from the static mixer enters the cup, and a transport position wherein the cup is further from the nozzle end of the static mixer such that fluid displaced from the static mixer does not enter the cup; said displacement controlled through the controller.

In certain embodiments, the liquid coating cart further comprises a waste catch situated below the nozzle end of the static mixer such that, when the fluid dispensing unit is in the transport position, fluid displaced from the nozzle end of the static mixer falls into said waste catch.

In certain embodiments, the liquid coating cart further comprises a platform, capable of linear displacement along the frame by means of a motor controlled by the controller, said platform housing the cartridge containment block, the ram system, and the fluid dispensing unit, which extends therefrom.

In certain embodiments, the liquid coating cart further comprises a solvent containment area within or proximal to the cartridge containment block, and capable of cleaning the static mixer nozzle by dispensing solvent through said static mixer and out of said nozzle end, said dispensing of solvent controlled by the controller.

In certain embodiments, the controller is a programmable logic controller or a personal computer based controller.

In certain embodiments the liquid coating cart further comprises a coupling at or near the rear end, for providing mechanical and electrical connection to a tractor cart.

In certain embodiments, the liquid coating cart further comprises an air blowoff unit capable of blowing air to displace dust or debris from the inside surface of the pipe, said air blowoff unit controlled by the controller.

In certain embodiments, the liquid coating cart further comprises a camera and a light source, mounted onto the frame and capable of transmitting images of the interior surface of the pipe, said camera and light source controlled by the controller.

In certain embodiments, images are transmitted to the remote interface via the controller.

In certain embodiments, the wheels are adjustable for fitting the liquid coating cart into pipes of different diameters.

In certain embodiments, the liquid coating cart further comprises a distance measuring encoder wheel capable of measuring a distance travelled along the pipe, and sending information relating to said distance travelled through the controller.

DETAILED DESCRIPTION OF THE PREFERRED EMBODIMENTS

Figure 1:
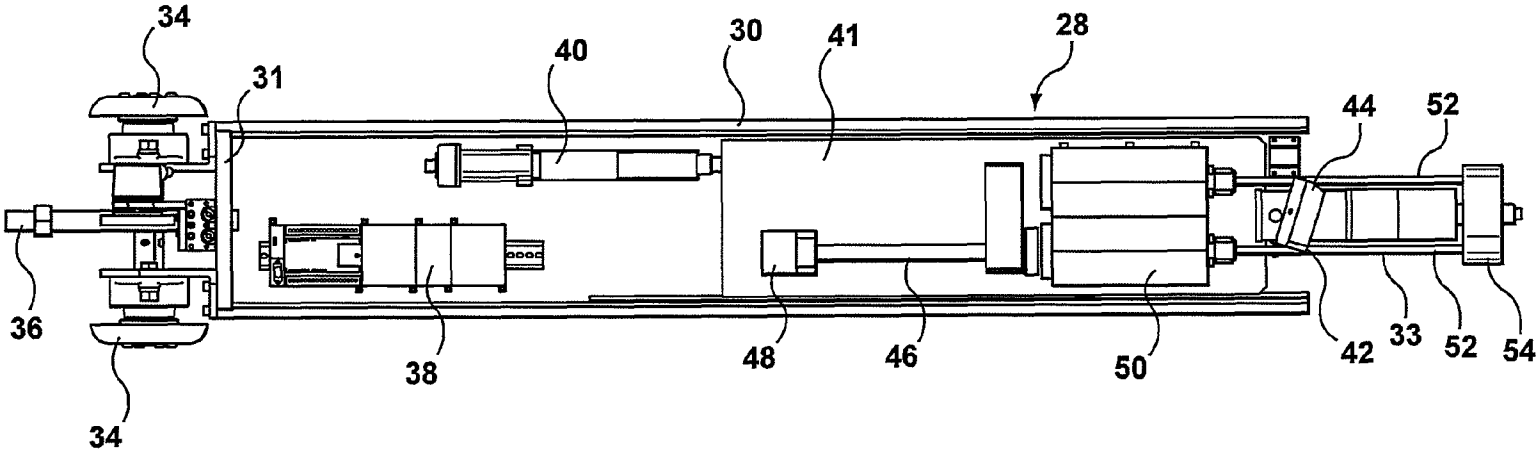
FIG. 1 is a top view of a liquid coating cart made in accordance with an embodiment of the invention.
Figure 2:
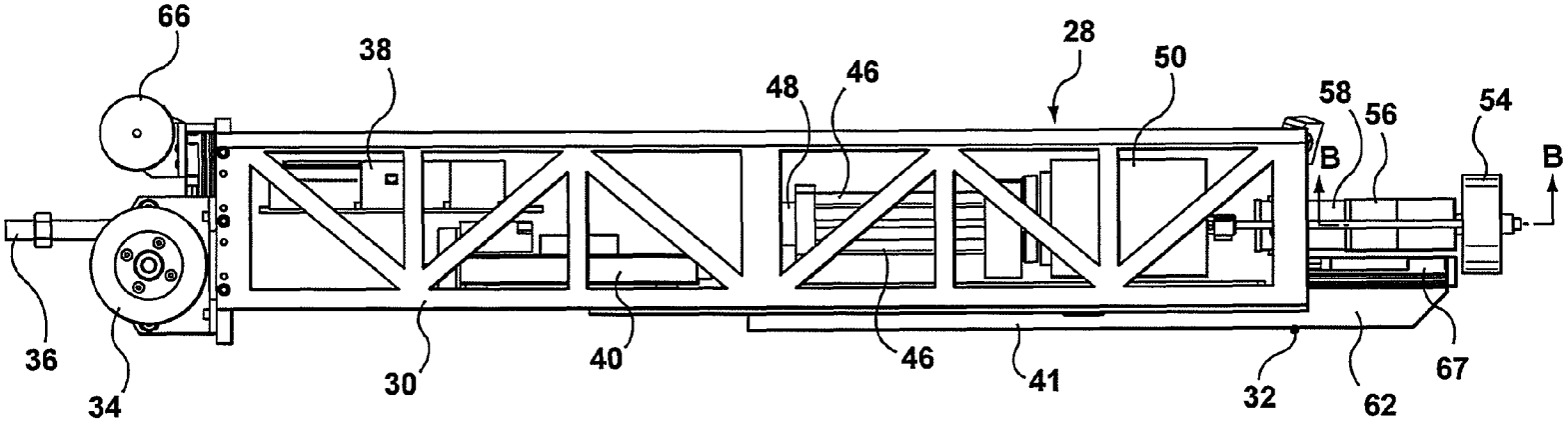
FIG. 2 is a side view of the liquid coating cart of FIG. 1.
Figure 3:
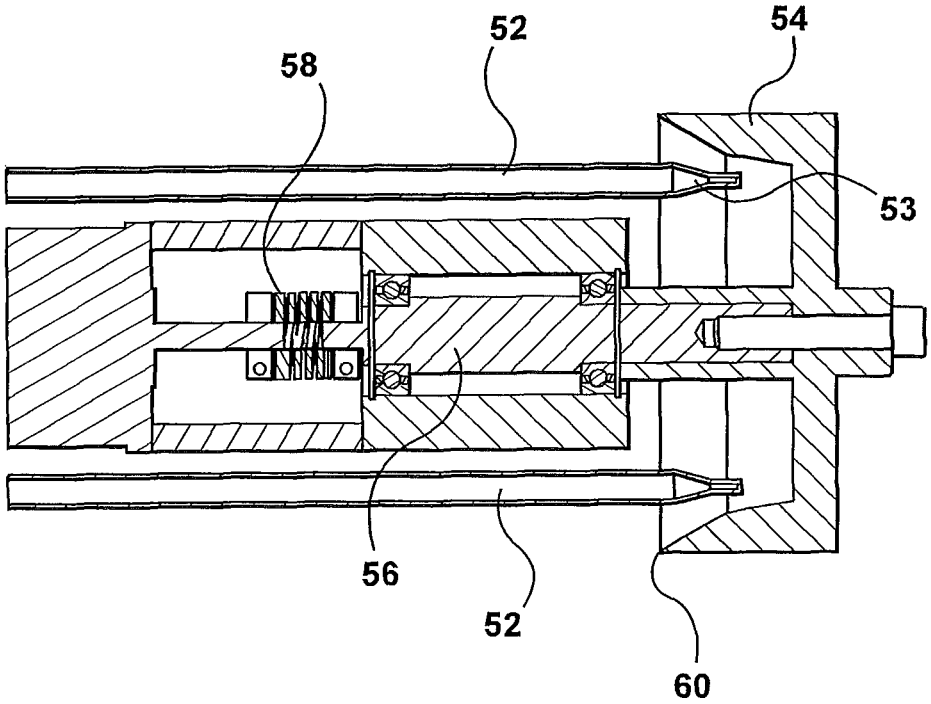
FIG. 3 is a section view of the section B-B as shown in FIG. 2.

Referring now to FIGS. 1-4, a liquid coating cart 28 has a frame 30 for containing many of its components. Attached to the frame 30 at a rear end 31 are rear wheels 34, which are capable of resting on the inside surface of a pipe 70. Attached proximal to a front end 33 are front wheels (not shown, but placed at or near front wheel placement 32). The front wheels are far enough back from the front end 33 so that they are not sprayed by fluid leaving cup 54 (described further, below).

Also at rear end 31 is coupling 36 for mechanically and electrically connecting the liquid coating cart 28 to a tractor cart used in the field (not shown), for example, a battery powered tractor cart. Typically, the tractor cart has a control system and communications antenna, and the electrical connection at coupling 36 between the liquid coating cart 28 and the tractor cart provides a common network between the tractor cart, the liquid coating cart, and a remote control unit (not shown) on which an operator can control the operations of the carts. Optionally (not shown), the liquid coating cart 28 may be mechanically and electrically connected but have its own, separate, control system and communications antenna (not shown), with the electrical connection simply used to provide power to the components of the liquid coating cart 28. Alternatively, but not shown, the coupling may be optional, with the liquid coating cart having its own power supply, control system, and communications antenna, and not relying on a tractor cart.

The liquid coating cart 28 is equipped with a controller 38, such as a programmable logic controller, capable of controlling the various motors and elements of the liquid coating cart 28, as described further below. The controller 38 can receive instructions from the remote control unit (not shown) via the tractor cart communications antenna, and can send information received from the various elements of the liquid coating cart 28 (for example, the camera 42, described further below) in the same manner. Alternatively, the controller 38 can receive instructions from the remote control unit (not shown) via its own communications antenna (not shown), on the liquid coating cart 28.

The frame 30 also houses camera 42 and lights 44, which can be used to locate holidays or defects in the pipe coating. Camera 42 can send image signals to a user through the programmable logic controller 38, and the communications antenna of the tractor cart. Camera 42 can be used to confirm that the liquid coating cart 28 is working properly, and can ensure that sufficient coating of the pipe has occurred.

Frame 30 also houses platform 41 which can be displaced laterally in relation to frame 30 by electric linear activator 40. Attached to platform 41 is a heated cartridge containment block 50, which houses one or more (as shown, two) optionally disposable, fluid cartridges (not shown). The fluid cartridges contain the fluid that is to coat the inside of the pipe. The cartridge containment block 50 is capable of heating the fluid contained in the fluid cartridges. Fluid contained in the fluid cartridges is forced out by rams 46 which are displaced using linear stepper drive 48. Optionally, there are multiple rams 46 which allow displacement of fluid from multiple fluid cartridges. As shown, there are two rams 46, which allow displacement of two different fluids from the fluid cartridges into static mixer 52. For example, and as shown, each fluid cartridge hold one part of a two part epoxy. The rams 46 displace the fluid from the fluid cartridges, and the two parts of the epoxy are mixed in static mixer 52. The mixed two part epoxy solution exits static mixer 52 through nozzle 53 and onto the inner surface of cup 54. Cup 54 rotates around axle 56 at high speed, driven by cup drive motor 58, as shown being a direct connect motor. Centrifugal force forces the solution to the side wall 60 of the cup 54, which is angled to facilitate expulsion of liquid out of the top of the cup 54.

Optionally (not shown), the fluid containment block 50 can hold an additional fluid cartridge for solvent or other cleaning fluid, which can be used to clean the static mixer 52, nozzle 53, and/or cup 54 in situ. Displacement of fluid from this cartridge would be performed in a manner similar to that described above.

Also optionally (not shown), instead of or in addition to having a platform 41 laterally displaceable on frame 30, the entire liquid coating cart 28 can be laterally displaced along the pipe when coating, either utilizing the power of the tractor cart or under its own power.

Cup 54 location relative to nozzles 53 can be adjusted through cup and motor slide axis 62. Frame 30 also comprises a distance measuring encoder wheel 66 to help determine the approximate location of the liquid coating cart 28 within the pipe.

Figure 5:
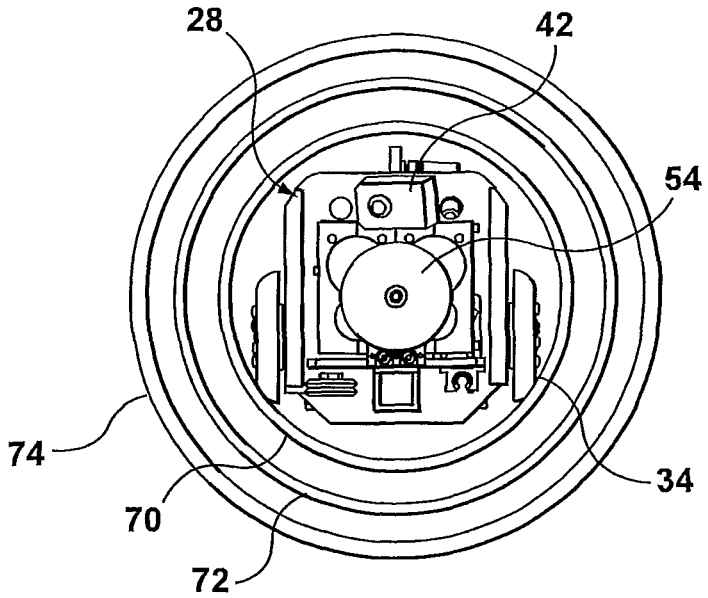
FIG. 5 is a front view of the liquid coating cart of FIG. 1, shown within a pipe.
Figure 4:
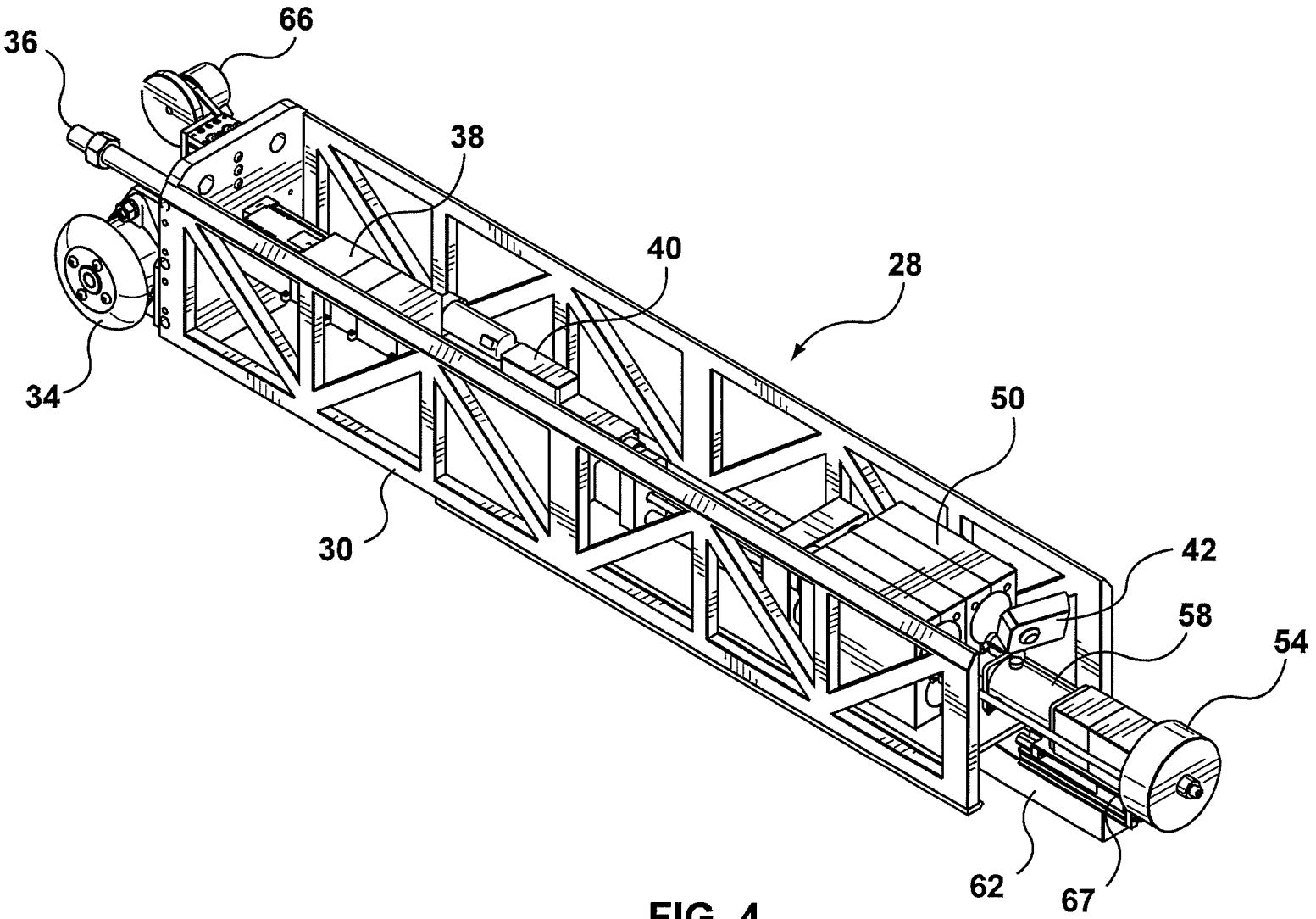
FIG. 4 is an auxiliary view of the liquid coating cart of FIG. 1.

FIG. 5 shows a front view of the liquid coating cart 28 within the environment of a pipe 70. Pipe 70 is a 16" pipe. Preferably, and as shown, the liquid coating cart 28 is located such that the axel 56 and cup 54 are located at or around the center of the pipe 70. This allows for even coating of the pipe by liquid expulsed from the top of cup 54.

Not shown, but as would be evident to a person of skill in the art, the liquid coating cart 28 could also be used within a larger pipe, for example, a 20" pipe 72 or a 24" pipe 74 simply by replacing or adjusting the length of the axles of rear wheels 34 and front wheels (not shown). The wheels 34 themselves may also be replaced in order to have the desired angle of contact between the wheels 34 and the pipe 72 or 74. For example, the liquid coating cart 28 can come equipped with three sets of wheel 34, each having axles of different lengths and different angles of contact between the wheel 34 and the pipe 70, 72, 74, to optimize fitting the liquid coating cart 28 in pipes of different diameters. Other pipe widths, for example pipes of 4 or 6 feet in diameter can also be coated, using a similar device to that shown, but made to a larger scale.

Figure 6:
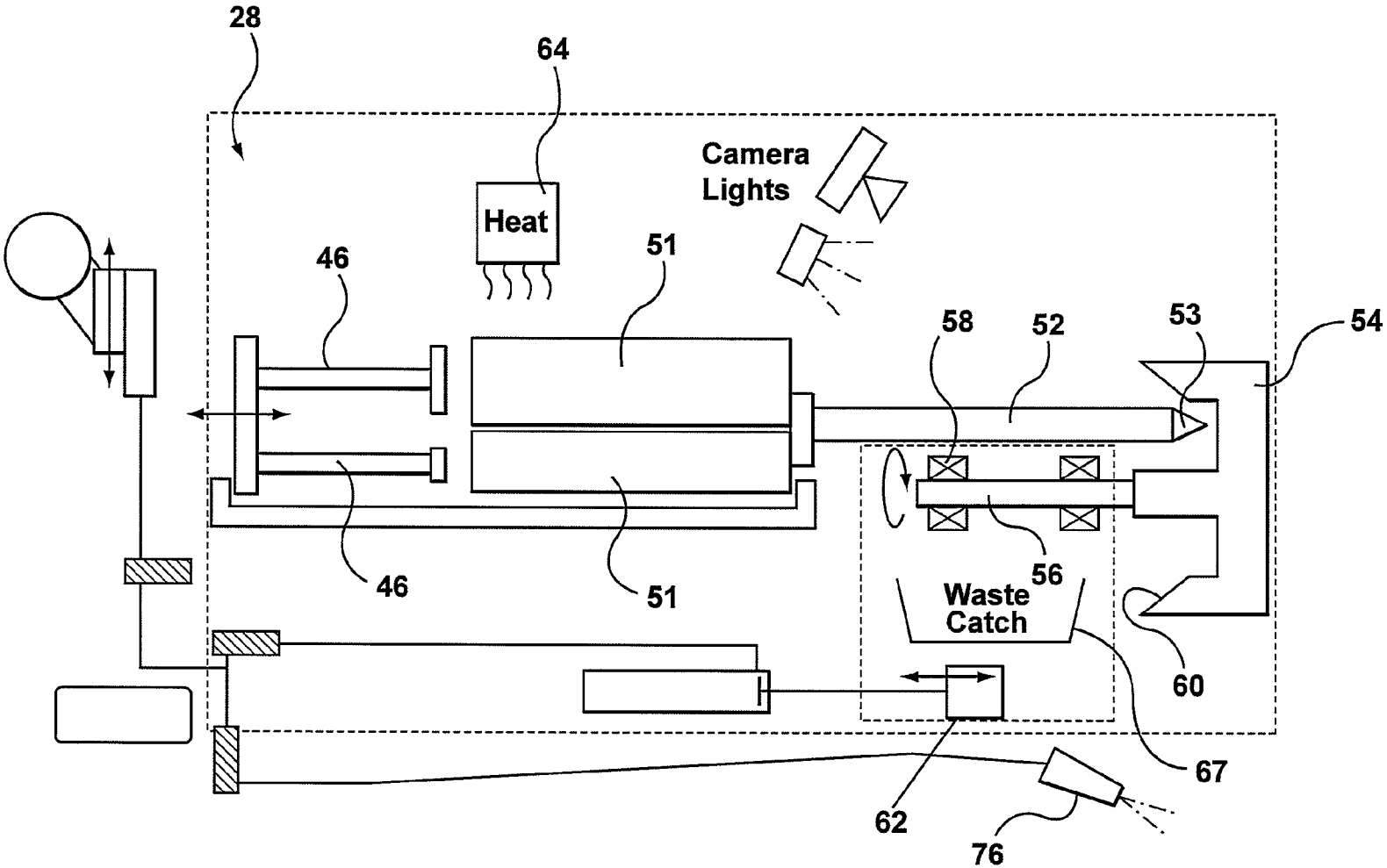
FIG. 6 is a schematic view of the components of the liquid coating cart.

FIG. 6 shows a schematic view of the liquid coating cart 28, showing aspects not shown in FIGS. 1-5. Here, one can see rams 46 which are capable of lateral displacement. Rams 46 can enter fluid containers 51, forcing fluid out of the opposing end of fluid containers 51 (for example a fluid cartridge) and into static mixer 52. Using this same force (the lateral displacement of rams 46) the mixed fluid is then forced out of the nozzle 53 of static mixer 52 and into cup 54, which is rotating along axle 56 powered by cup drive motor 58. Not shown in FIGS. 1-5 is waste catch 67. When spraying fluid, nozzle 53 is at the location shown in the figures, and proximal to cup 54. However, when the liquid coating cart 28 is being transported from one location to another, or when it is not desired to spray fluid, platform 41 is displaced relative to cup 54, and the nozzle 53 is positioned to be directly above waste catch 67. During transport or otherwise when the liquid spray cart 28 is not spraying liquid, rams 46 continue to push fluid through static mixer 52, and out of nozzle 53, but at a reduced rate. This prevents fluid from curing or hardening within static mixer 52, since the fluid in the static mixer 52 is constantly in a state of motion.

Also shown in FIG. 6 is heating element 64, which, in FIGS. 1-5, is present, but incorporated within heated cartridge containment block 50. This heating element 64 serves to heat the fluid within fluid container 51.

FIG. 6 also shows air blowoff 76 which is capable of blasting air against the interior pipe wall, clearing it of debris or dust before application of the fluid coating.

Figure 7:
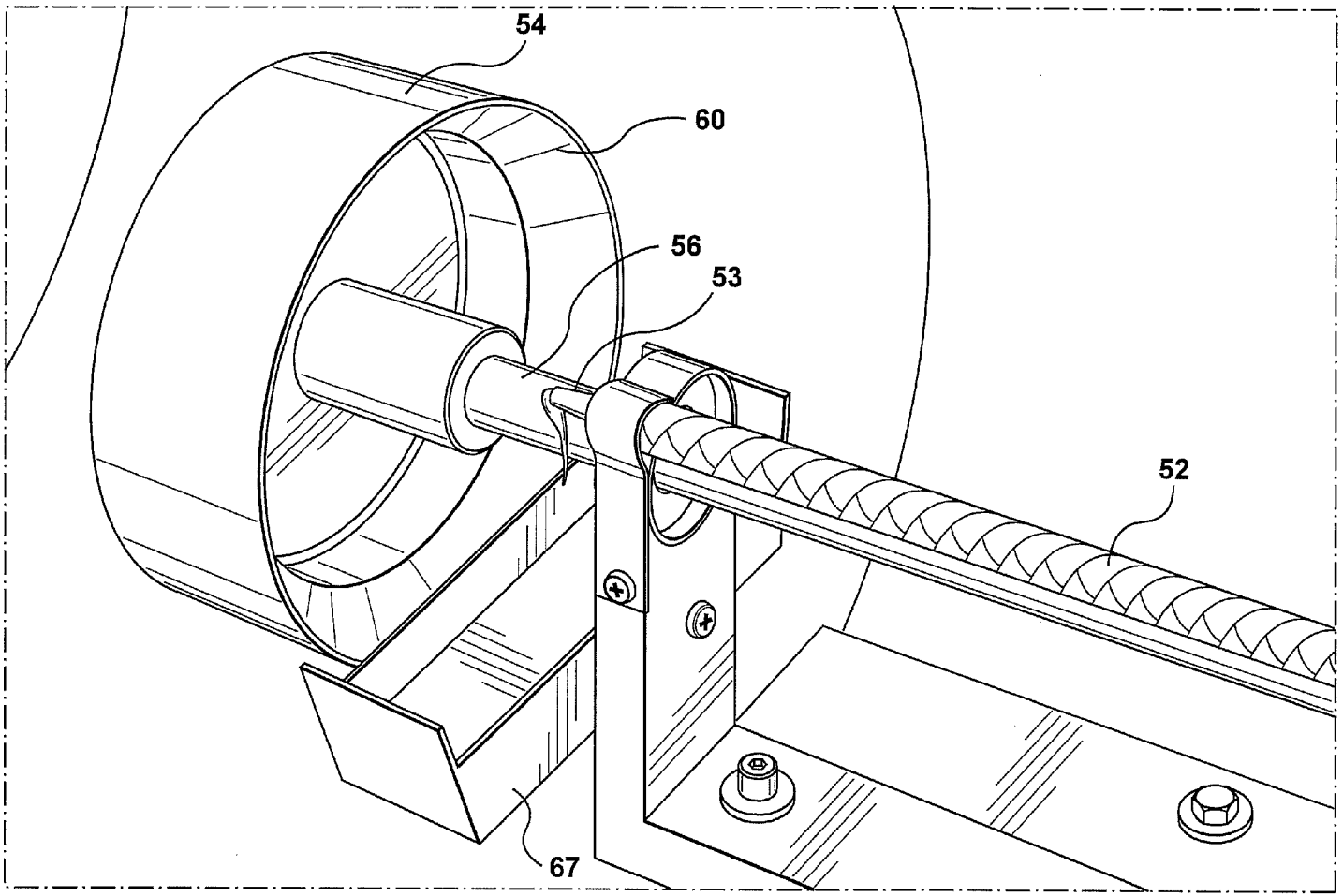
FIG. 7 is a photograph of the cup and other elements of a liquid coating cart according to the invention.

FIG. 7 is a photograph showing the cup 54 and other aspects of the liquid coating cart 28.

Figure 8A:
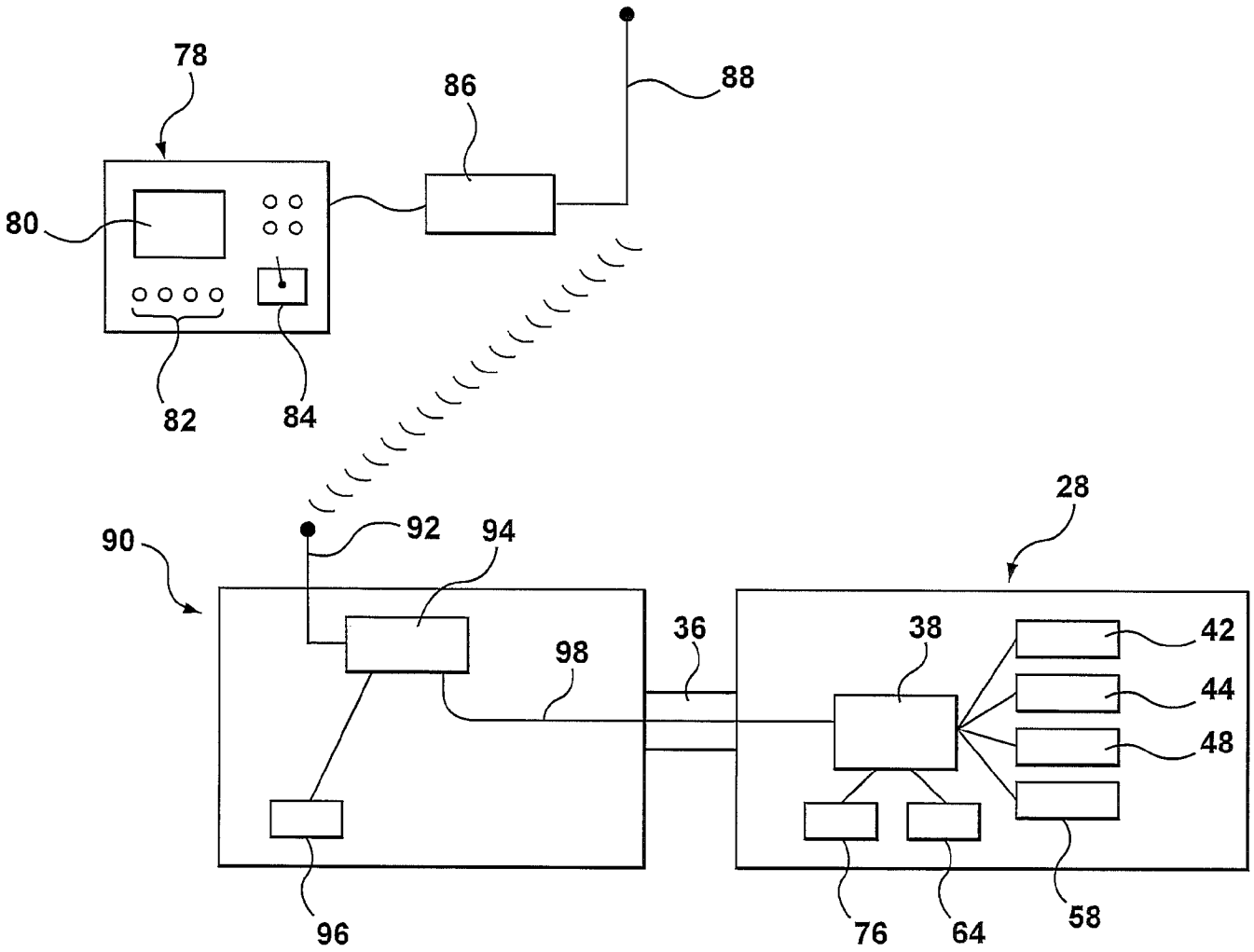
FIGS. 8A and 8B are schematic representations of two possible control systems for the liquid coating cart.

FIG. 8A is a schematic of a liquid coating cart 28 control system. An alternative liquid coating cart 28 control system is shown in FIG. 8B.

As shown in FIG. 8A, a user operates control panel 78, which has a screen 80 (for example, an LCD panel), and a variety of controls 82, 84. Through the control panel 78, the user can view what is being seen by camera 42, as well as operate the various elements of the liquid control cart 28. The control panel 78 is connected, through a computer 86, to a telecommunications antenna 88, capable of sending and receiving signal to the liquid coating cart 28, through tractor cart 90. An antenna 92 on the tractor cart 90 receives and sends this signal to telecommunications antenna 88. Antenna 92 is connected to a controller 94 which operates the tractor cart 90 functions, for example, the activation of motor 96 for operating the wheels of the tractor cart 90. Controller 94 is also connected, through connector 98 and through coupling 36 to controller 38 on the liquid coating cart 28. Through the controller 38, a user operating the control panel 78 is able to control various aspects of the liquid coating cart 28, such as camera 42, lights 44, activation and speed of linear stepper drive 48, activation of the electric linear activator 40, activation and speed of cup drive motor 58, heating element 64, and activation of air blowoff 76.

Figure 8B:
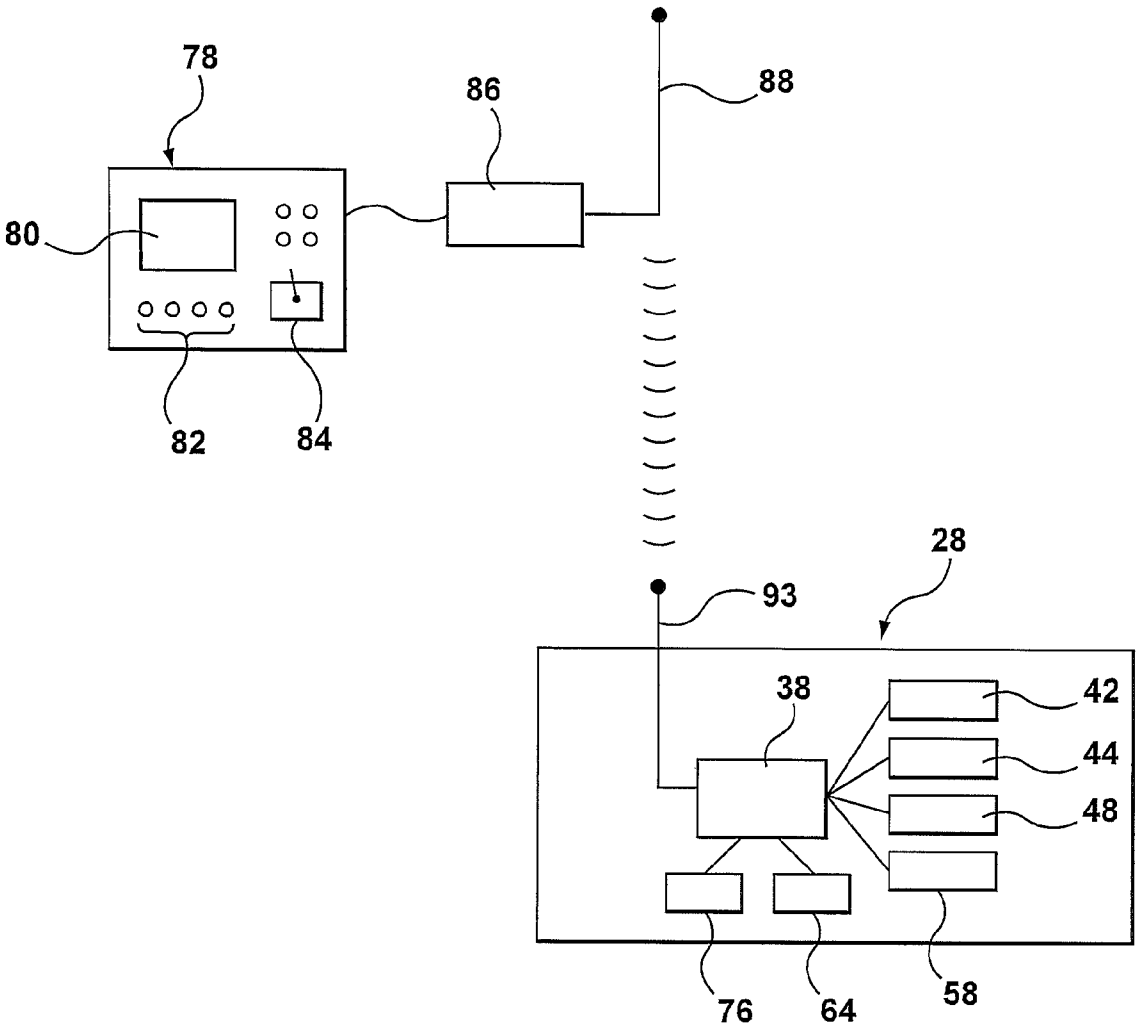

As shown in FIG. 8B, the user operates control panel 78 in a manner similar to that shown in FIG. 8A. However, the telecommunications antenna 88 is capable of sending and receiving signal to the liquid coating cart 28 directly, instead of through tractor cart 90. An antenna 93 on the liquid coating cart receives and sends this signal to telecommunications antenna 88. Antenna 93 is connected to controller 38 on the liquid coating cart 28; through the controller 38, the user operating the control panel 78 is able to control various aspects of the liquid coating cart 28, in a manner similar to that shown in FIG. 8A.

The liquid coating cart 28 is used in the following manner. A holiday/defect location is identified with other, known, inspection equipment. The liquid coating cart 28 is mechanically and electrically connected to a battery powered tractor cart through coupling 36. The tractor cart has a control system and a communications antenna attached, and communicates via said communications antenna with a mobile control unit which is operated by a user. Once the liquid coating cart 28 is thus connected, communications are established between the liquid coating cart 28 and the mobile user interface via the wireless communications system.

Fluid containers 51, which may be in the form of a disposable, proprietary cartridge, containing fluid, are loaded onto the liquid coating cart 28, within the cartridge containment block 50. Optionally, static mixers 52 are also loaded, in the case (as shown) where static mixers 52 are a disposable consumable. Optionally, depending on what kind of liquid is contained within the fluid containers 52, the liquid in the fluid containers 51, and, again optionally, the static mixers 52 and the cup 54, are heated by activation of the heating element 64.

The liquid coating cart 28 is placed into an open end, or an access panel, of a pipeline. The liquid coating cart 28 is then driven to the defect furthest from the insertion point in the particular string of pipe, optionally using distance measuring encoder wheel 66 to track the distance. In some cases tractor cart 90 may also have a distance measuring system, such as an electronic encoder, in which case, this may be used instead of distance measuring encoder wheel 66.

The precise defect location is then optionally located and verified manually by way of visual confirmation utilizing camera 42, in conjunction with distance measuring encoder wheel 66. An air blast against the base of the pipe is provided to move any large debris or dust from the coating area, through the activation of air blowoff 76.

The coating procedure is then initiated, as follows. The dispensing cup 54 is retracted to the operating position, proximal to mixer nozzle 53. This allows the mixer nozzle 53 to deposit material within the cup 54. The cup is then spun at high speed through the activation of cup drive motor 58. The platform 41 which holds the cartridge containment block 50, the mixer 52, and the cup 54 is then moved in a reciprocating fashion by way of electric linear activator 40. The total stroke of travel is approximately 10" or less; the rate of travel is adjustable and based on the viscocity and other characteristics of the fluid, and can be approximately 1" per second. This allows the cup 54 to coat/overcoat a section of pipe approximately 10" in length, more than sufficient for covering any coating defect. The user then activates the linear stepper drive 48, a mechanical screw mechanism driven by a motor, which moves rams 46, which are moved forward at a controlled rate. The rams 46 force liquid out of fluid container 51 and into mixer 52, and then out of mixer 52 through nozzle 53 and into cup 54, which expels the mixed liquid onto the interior wall of the pipe. The rams 46 can be moved separately or independently, for example, where it is desired to use more fluid from one fluid container 51 than the other (for a specific fluid ratio mix), this can be done. Based on feedback from an linear variable differential transformer sensor (not shown), the rams 46 are stopped after the desired distance of travel has been achieved, said distance relating to the total volume of epoxy dispensed. Optionally, instead of stopping completely, the rams 46 are slowed down to a much slower speed. Cup 54 continues to rotate for a period of time, to ensure the fluid dose is fully dispensed; the cup 54 is then stopped, as is the platform travel. The platform is then moved back to a retracted position, and the cup 54 is moved to the extended position, approximately 3" from the retracted position. This enables the mixer nozzle 53 to overhang waste catch 67, for collection of leakage and purged epoxy.

The static mixer 52 is periodically purged, through motion of rams 46 a small, measured amount, or, as described above, through the continual motion of rams 46 at a much slower than standard operational speed. This prevents the fluid in the static mixer from curing, hardening, or otherwise thickening to the point where it no longer dispenses satisfactorily. Accordingly, small volumes of fluid are dispensed through nozzle 53 and into waste catch 67.

Once coating has been achieved, the user can perform a visual verification of overcoat utilizing camera 42. A photo of the joint is taken for the data log. The liquid coating cart 28 is then driven to the defect location second furthest from the insertion point, and the process repeated. The process is repeated again for each defect, until all defects are repaired or resources are depleted.

ELEMENT LIST

28 liquid coating cart
30 frame
31 rear end
32 front wheel placement
33 front end
34 rear wheels
36 coupling
38 programmable logic controller
40 electric linear activator
41 platform
42 camera
44 lights
46 rams
48 linear stepper drive
50 cartridge containment block
51 fluid container
52 static mixer
53 nozzle
54 cup
56 axle
58 cup drive motor
60 side wall
62 cup and motor slide axis
64 heating element
66 distance measuring encoder wheel
67 waste catch
70 pipe
72 20" pipe
74 24" pipe
76 air blowoff
78 control panel
80 screen
82, 84 controls
86 computer
88 telecommunications antenna
90 tractor cart
92 antenna
93 antenna
94 controller
96 motor
98 connector

The invention claimed is:

1. A liquid coating cart for coating an inside surface of a pipe, comprising:

(a) a frame, having a rear end and a front end, and wheels capable of displacing the frame along the inside surface of the pipe;

(b) a controller, capable of receiving instructions from a remote interface;

(c) a cartridge containment block, capable of housing at least two fluid cartridges, each of said fluid cartridges containing fluid for coating the inside surface of the pipe;

(d) a housing for a static mixer, located in or proximal to the cartridge containment block, and situated such that when fitted with a static mixer having a feeding end and a nozzle end, a channel is formed between the fluid cartridges and the feeding end of the static mixer, through which the fluid can be displaced;

(e) a ram system capable of displacing said fluid out of said fluid cartridges and into said static mixer when said fluid cartridges and static mixer are fitted to said cartridge containment block and housing, respectively, and then through said static mixer and out of said nozzle end, said ram system controlled through the controller; and (f) a fluid dispensing unit, comprising a cup having an interior bottom and an interior sidewall, said cup connected to a cup drive motor capable of rotating said cup around an axle connected to its interior bottom, said cup drive motor controlled through the controller;

said fluid dispensing unit capable of displacement between two positions, an operating position wherein the cup is proximal to the nozzle end of the static mixer such that fluid displaced from the static mixer enters the cup, and a transport position wherein the cup is further from the nozzle end of the static mixer such that fluid displaced from the static mixer does not enter the cup; said displacement controlled through the controller;

wherein the controller controls the ram system and the cup drive motor.

2. The liquid coating cart of claim 1 further comprising a waste catch situated below the nozzle end of the static mixer such that, when the fluid dispensing unit is in the transport position, fluid displaced from the nozzle end of the static mixer falls into said waste catch.

3. The liquid coating cart of claim 1 further comprising a platform, capable of linear displacement along the frame by means of a motor controlled by the controller, said platform housing the cartridge containment block, the ram system, and the fluid dispensing unit.

4. The liquid coating cart of claim 3 wherein the fluid dispensing unit extends laterally from the platform.

5. The liquid coating cart of claim 1 further comprising a solvent containment area within or proximal to the cartridge containment block, and capable of cleaning the static mixer nozzle by dispensing solvent through said static mixer and out of said nozzle end, said dispensing of solvent controlled by the controller.

6. The liquid coating cart of claim 1, wherein the controller is a programmable logic controller.

7. The Liquid coating cart of claim 1, wherein the controller is a personal computer based controller.

8. The liquid coating cart of claim 1, further comprising a coupling at or near the rear end, for providing mechanical and electrical connection to a tractor cart.

9. The liquid coating cart of claim 1, further comprising an air blowoff unit capable of blowing air to displace dust or debris from the inside surface of the pipe, said air blowoff unit controlled by the controller.

10. The liquid coating cart of claim 1, further comprising a camera and a light source, mounted onto the frame and capable of transmitting images of the interior surface of the pipe, said camera and light source controlled by the controller.

11. The liquid coating cart of claim 10 wherein the images are transmitted to the remote interface via the controller.

12. The liquid coating cart of claim 1 wherein the wheels are adjustable for fitting the liquid coating cart into pipes of different diameters.

13. The liquid coating cart of claim 1 further comprising a distance measuring encoder wheel capable of measuring a distance travelled along the pipe, and sending information relating to said distance travelled through the controller.

* * * * *